United States Patent [19]

Powers et al.

[11] 4,298,485

[45] Nov. 3, 1981

[54] PROCESS OF PREPARING LUBRICATING OIL ADDITIVE CONTAINING TUNGSTEN

[75] Inventors: John A. Powers, New Albany; James N. Christini, Towanda, both of Pa.

[73] Assignee: GTE Products Corporation, Stamford, Conn.

[21] Appl. No.: 159,542

[22] Filed: Jun. 16, 1980

[51] Int. Cl.[3] ..... C10M 1/10; C10M 1/54

[52] U.S. Cl. ..... 252/49.7; 423/54

[58] Field of Search ..... 252/49.7; 423/54

[56] References Cited

U.S. PATENT DOCUMENTS 3,052,516 9/1962 Drobnick et al. ..... 423/54

3,158,438 11/1964 Kurtak ..... 423/54

3,290,245 12/1966 Elliott et al. ..... 252/49.7 X 3,316,058 4/1967 Chaney ..... 423/54

*Primary Examiner*—Andrew Metz

*Attorney, Agent, or Firm*—Robert E. Walter

[57] ABSTRACT

A lubricating oil additive is produced by contacting an aqueous slurry of ammonium paratungstate with an organic phase comprising a major proportion by weight tertiary alkyl amines having the formula $C_nH_{2n+1}NH_2$, where n is from 18 to 22, to extract the tungsten into the organic phase from the aqueous phase while solid ammonium paratungstate is being solubilized into the aqueous phase. The aqueous phase is heated to drive off water so as to form the resulting lubricating oil additive.

7 Claims, No Drawings

PROCESS OF PREPARING LUBRICATING OIL ADDITIVE CONTAINING TUNGSTEN

BACKGROUND OF THE INVENTION

The present invention relates to a process for producing a lubricating oil additive containing tungsten.

Present day lubricating oils contain various additives that impart desirable characteristics such as detergency, antioxident, antisludge, anticorrosion and antiwear properties. Material such as the amine salts of molybdic or tungstic acid are used to impart sludge dispersency, high temperature detergency and antifriction properties.

It is an object of the present invention to provide an improved process for producing an oil additive containing tungsten.

Other and further objects of the present invention will become apparent from reading the following description.

SUMMARY OF THE INVENTION

In accordance with the present invention, there is provided a process for producing a lubricating oil additive containing a predetermined amount of a tungsten species comprising contacting a predetermined amount of ammonium paratungstate present in an aqueous slurry comprising a solid portion of ammonium paratungstate with an organic phase comprising a major proportion by weight of a tertiary alkyl amine having the formula $C_nH_{2n+1}NH_2$ where n is from 18 to 22, for extracting ammonium paratungstate from the aqueous phase into the organic phase while solid ammonium paratungstate is being solubilized into the aqueous phase, said contacting being carried out until substantially all of said solids are solubilized, removing substantially all of the water present in the aqueous phase by subjecting said aqueous phase to vaporizing conditions whereby ammonium paratungstate is absorbed into the organic phase to form a lubricating oil additive containing a predetermined amount of tungsten species based on the predetermined amount of ammonium paratungstate.

DETAILED DESCRIPTION

The tungsten source for the lubricating oil additive as produced in the process of the present invention is ammonium paratungstate. Due to the relative insolubility of ammonium paratungstate in water solutions, ammonium paratungstate is utilized in the form of a slurry containing ammonium paratungstate solids or crystals suspended in the aqueous phase which consists essentially of water. The solids are in phase equilibrium with the saturated aqueous solution containing dissolved ammonium paratungstate. It is desirable to use at least a sufficient amount of ammonium paratungstate in the slurry as is needed to yield the desired amount of tungsten species in the final lubricating oil additive. Typical starting aqueous slurries used to produce lubricating oil comprise about one part by weight ammonium paratungstate to about three to about four parts by weight water. More preferably the starting solution comprises about one part by weight ammonium paratungstate to about 3.5 parts by weight water.

The aqueous slurry is contacted with an organic base comprising a major proportion by weight of tertiary alkyl amines having the formula $C_nH_{2n+1}NH_2$, where n is from 18 to 22. The preferred tertiary amine comprises a mixture containing a large proportion of isomeric tertiary amines having from about 18 to about 22 carbons. The tertiary amines are preferred since they are mobile liquids at ambient temperature and retain low viscosity over a broad range of temperatures extending far below ambient temperatures. The tertiary alkyl amines utilized are soluble in petroleum solvents and resistant to oxidation. The preferred tertiary alkyl amine has a boiling range of from about 97° C. to about 152° C. over which from about 5 to about 70 percent of the amine will vaporize. At 25° C., the specific gravity is preferably about 0.840 and the density is about 7.0 pounds per gallon. The refractive index $n_D^{25}$ is about 1.45. The most preferred tertiary alkyl amine is sold under the trademark Primene JM-T by Rohm and Haas of Philadelphia, Pennsylvania.

The aqueous slurry containing ammonium paratungstate and the organic phase is contacted for a sufficient period of time to load the organic phase with tungsten species. The contacting may be carried out by any of the well known procedures employed in liquid-liquid extractions where the aqueous phase is dispersed in the organic phase or the organic phase is dispersed in the aqueous phase. Any suitable contacting means such as a column, a vessel equipped with a mixer or merely shaking the organic phase and aqueous phase in a closed container may be utilized. The preferred contacting step is carried out by dispersing the organic phase in the aqueous phase. The contacting step should be continued until substantially all the solids are solubilized into the aqueous phase as evidenced by the disappearance of solids. The aqueous phase acts as a solubility bridge with solid ammonium paratungstate dissolving into the aqueous phase as ammonium paratungstate from the aqueous phase is extracted into the organic phase. The disappearance of solids from the aqueous phase will characterize the point at which the contacting step may be discontinued. Generally, it has been found that contacting times on the order of three to about six hours and more preferably from about four to about five hours may be conveniently employed wherein good contact is established between the organic and aqueous phase. Water may be added during the contacting step to maintain the original volume of aqueous phase. It is preferred to maintain the temperature during contacting from about 85° C. to about 100° C. Generally, shorter periods of contact and lower temperatures lower the efficiency of the extraction. When a tertiary amine having alkyl chains of from about 18 to 22 carbon atoms is employed as the organic phase it is preferable to contact about 3 parts by weight organic phase with an aqueous phase comprising about one part by weight ammonium paratungstate.

The organic phase containing the extracted tungsten species is separated from the aqueous phase by vaporizing water from the aqueous phase due to the difference in boiling points between the aqueous and organic liquid. The organic phase containing extracted tungsten species preferably has a boiling point higher than the aqueous solution of ammonium paratungstate to permit removal of water by vaporization without unduly vaporizing the organic phase. The aqueous phase is heated at a suitable temperature for a sufficient period of time to drive off excess water and ammonia to form a lubricating oil additive. The dissolved ammonium paratungstate is absorbed into the organic phase as the vaporizing step proceeds. The final oil additive comprises greater than about 15 percent by weight tungsten and less than about 3 percent by weight water. Preferably the resulting lubricating oil additive comprises greater than about 19 percent tungsten by weight and more preferably has a specific gravity of about 1.0 to about 1.2. More preferably, the lubricating oil additive comprises about 19 percent tungsten and comprises about one tungsten species per two tertiary alkyl amine species. To remove water from the organic phase it is preferable to heat the organic phase at a temperature greater than about 100° C. to drive off the water while minimizing loss of organics for a period of about one to two hours. The temperature and time will vary depending on the composition of the organic phase and the amount of water present. Greater times being needed for lower temperatures and higher water content.

The amount of ammonium paratungstate loaded into the aqueous slurry may be adjusted so as to obtain the final desired amount of tungsten species in the final lubricating oil additive. Knowing the amount of organic used, the amount of tungsten may be determined by weighing the final lubricating oil additive and subtracting the weight of organic provided organic has not been less due to volitlization. More or less ammonium paratungstate may be used so as to arrive at the desired final concentration of tungsten species.

To more fully illustrate this invention the following detailed examples are presented. All parts, portions ratios and percentages are on a weight basis unless otherwise stated.

EXAMPLE 1

About 100 grams of pure ammonium paratungstate crystals are added to about 350 milliliters of water and mixed to form a slurry. The slurry is heated to about 93° C. while being agitated and 294 grams of Primene JM-T tertiary alkyl amine is added. The mixture is maintained at a temperature of 85° C. while being agitated for a period of about four hours after which solids present in the slurry disappear. The mixture including organic phase and aqueous phase is heated at a temperature over about 100° C. until substantially all the water is driven off. The remaining lubricating oil additive is analyzed as having a specific gravity of about 1.097 and containing about 18.4 percent tungsten by weight and about 2 percent by weight water.

EXAMPLE 2

The procedure as described in Example 1 is followed using 110 grams of ammonium paratungstate and 350 milliliters of water. The final lubricating oil additive produced as a specific gravity of 1.120 and contains about 21.3 percent tungsten by weight.

While there has been shown and described what are at present considered to be the preferred embodiments of the present invention, it will be obvious to those skilled in the art that various changes and modifications may be made therein without departing from the scope of the invention as defined by appended claims.

We claim:

1. A process for producing a lubricating oil additive comprising a tertiary alkyl amine, greater than about 15 percent by weight tungsten, and less than about 3 percent by weight water said process comprising contacting an aqueous slurry consisting essentially of from about 3 to about 4 parts by weight water per part by weight ammonium paratungstate with about 3 parts by weight of an organic phase per part by weight ammonia paratungstate wherein said slurry comprises a solid portion of ammonium paratungstate, wherein said organic phase consists essentially of a major portion by weight of a tertiary alkyl amine having the formula $C_nH_{2n+1}NH_2$, where n is from 18 to 22, said contacting being carried out until substantially all of said solids are solubilized by extracting ammonium paratungstate from the aqueous phase into the organic phase while solid ammonium paratungstate is being solubilized into the aqueous phase, removing substantially all of the water present in the aqueous phase by subjecting said aqueous phase to vaporizing conditions to form a lubricating oil additive comprising less than about 3 percent by weight water and containing greater than about 15 percent by weight tungsten based on the amount of ammonium paratungstate used during contacting.

2. A process for producing a lubricating oil additive according to claim 1 wherein said contacting step is carried out by dispersing the organic phase in the aqueous phase.

3. A process for producing a motor oil additive containing tungsten species according to claim 1 wherein said organic phase has a specific gravity of about 0.840 at a temperature of about 25° C.

4. A process for producing a motor oil additive containing a tungsten species according to claim 1 wherein a major portion of said organic phase boils over the temperature range of from about 96° C. to about 152° C.

5. A process for producing a lubricating oil additive according to claim 4 wherein said contacting comprises mixing said aqueous slurry and said organic phase for a sufficient period of time for dispersing said organic phase.

6. A process for producing a lubricating oil additive according to claim 5 wherein said lubricating oil additive after heating comprises greater than about 19 percent tungsten by weight.

7. A process for producing a lubricating oil additive according to claim 6 wherein said lubricating additive has a specific gravity of about 1.0 to about 1.2.

* * * * *